United States Patent [19]

Koiwa

[11] Patent Number: 4,977,883

[45] Date of Patent: Dec. 18, 1990

[54] IGNITION CONTROL APPARATUS FOR AN INTERNAL COMBUSTION ENGINE

[75] Inventor: Mitsuru Koiwa, Himeji, Japan

[73] Assignee: Mitsubishi Denki Kabushiki Kaisha, Tokyo, Japan

[21] Appl. No.: 495,804

[22] Filed: Mar. 19, 1990

[30] Foreign Application Priority Data

Mar. 20, 1989 [JP] Japan ..... 1-66070

[51] Int. Cl.[5] ..... F02P 3/05; F02P 3/045

[52] U.S. Cl. ..... 123/644; 123/609

[58] Field of Search ..... 123/609, 610, 611, 623, 123/644, 651, 652

[56] References Cited

U.S. PATENT DOCUMENTS

| | | | |
|---|---|---|---|
| 4,440,130 | 4/1984 | Taguchi et al. | 123/644 X |
| 4,469,082 | 9/1984 | Mishitoba et al. | 123/644 X |
| 4,492,213 | 1/1985 | Yamamoto et al. | 123/644 |
| 4,552,118 | 11/1985 | Fukaya | 123/644 X |
| 4,558,684 | 12/1985 | Caddy et al. | 123/609 |
| 4,625,689 | 12/1986 | Komurasaki | 123/609 X |
| 4,658,788 | 4/1987 | Yamamoto et al. | 123/644 X |
| 4,739,743 | 4/1988 | Iwata | 123/609 |
| 4,799,471 | 1/1989 | Lasagna et al. | 123/644 |

FOREIGN PATENT DOCUMENTS

| | | | |
|---|---|---|---|
| 2524728 | 10/1983 | France | 123/644 |
| 0158536 | 12/1979 | Japan | 123/644 |
| 0220967 | 12/1983 | Japan | 123/623 |

*Primary Examiner*—Willis R. Wolfe

*Attorney, Agent, or Firm*—Sughrue, Mion, Zinn, Macpeak and Seas

[57] ABSTRACT

An ignition apparatus for an engine limits the primary winding current of an ignition coil to a prescribed level. The conducting time of drive transistors which control the primary winding current is controlled on the basis of the voltage across a capacitor which is charged by a signal generator. At normal engine speeds, when the primary winding current reaches the prescribed level, current is bypassed around the capacitor by a bypass transistor. When the engine is cranking and the signal generator voltage is low, a switching transistor disables the bypass transistor, and the capacitor is not bypassed, thereby preventing misfiring.

5 Claims, 2 Drawing Sheets

IGNITION CONTROL APPARATUS FOR AN INTERNAL COMBUSTION ENGINE

BACKGROUND OF THE INVENTION

This invention relates to an ignition control apparatus for a spark-ignited internal combustion engine. More particularly, it relates to an ignition control apparatus which can prevent improper ignition such as misfiring when an engine is starting.

In order to carry out proper ignition in an internal combustion engine, it is necessary for the current flowing through the primary winding of the ignition coil for the engine to reach a prescribed level. On the other hand, if the primary winding current exceeds this prescribed level, electric power from the storage battery for the engine, which is used to energize the ignition coil, will be needlessly consumed.

Therefore, many engines are equipped with ignition controllers which prevent the primary winding current from exceeding a prescribed current limit. However, conventional ignition controllers of this type have a number of drawbacks. For example, they generally employ elements having characteristics which vary significantly with operating temperature, and as a result a stable primary winding current can not be obtained. Furthermore, at very low engine speeds such as when an engine is cranking, it may be impossible with such ignition controllers to obtain an adequate current in the primary winding, resulting in ignition problems such as misfiring.

SUMMARY OF THE INVENTION

Accordingly, it is an object of the present invention to provide an ignition control apparatus for an internal combustion engine which can produce a stable and adequate primary winding current in an ignition coil for the engine even when the engine is starting.

In an ignition control apparatus according to the present invention, the duty cycle of a switching element which controls the primary winding current of an ignition coil is controlled in accordance with the voltage across a capacitor. The capacitor is charged by a signal generator which generates an output signal in synchrony with the rotation of the engine. When the engine is operating at a speed such that the capacitor voltage is above a prescribed level, a bypass circuit bypasses current from the signal generator around the capacitor when the primary winding current reaches an upper limit. When the engine is rotating at a low speed and the voltage across the capacitor is below a prescribed level, a bypass preventing circuit prevents the bypass circuit from bypassing the capacitor. As a result, an adequate primary winding current can be obtained even when the engine is cranking.

DESCRIPTION OF THE PREFERRED EMBODIMENT

Figure 1:
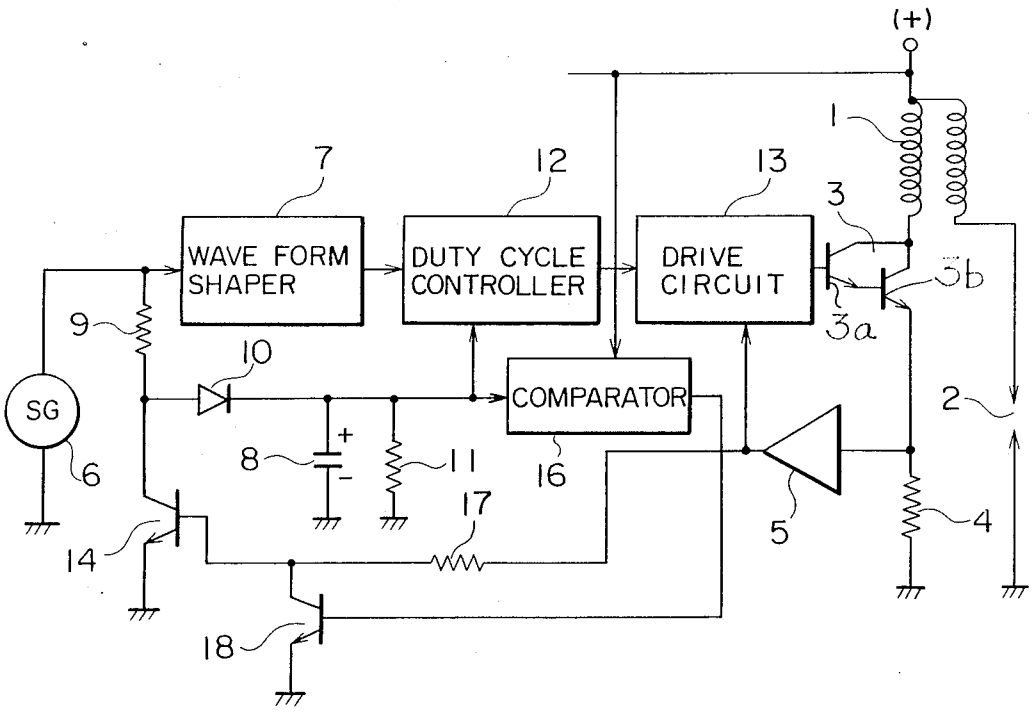
FIG. 1 is a circuit diagram of an embodiment of an ignition control apparatus according to the present invention.
Figure 2:
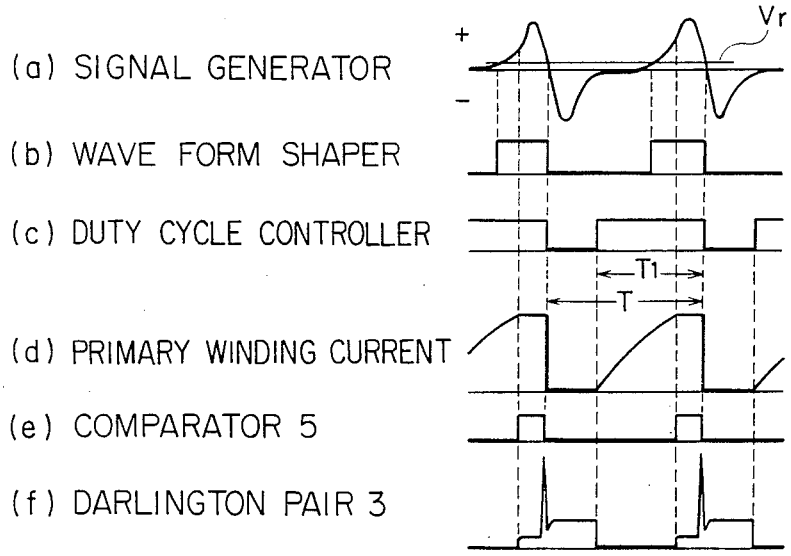
FIGS. 2, (*a*)–(*f*) are wave form diagrams showing the output signals of various portions of the embodiment of FIG. 1.

FIG. 1 schematically illustrates an embodiment of an ignition control apparatus according to the present invention as applied to an unillustrated multi-cylinder internal combustion engine, and FIG. 2 illustrates the output signals of various portions of this embodiment. As shown in FIG. 1, a signal generator 6 generates an alternating current output signal in synchrony with the rotation of the engine. Any type of conventionally employed for engine ignition control can be utilized, such as one which is rotated in synchrony with the crankshaft or the camshaft of the engine. FIG. 2*a* illustrates an example of the output signal of the signal generator 6. The period of the output signal is equal to the period between successive ignitions of the engine. For example, in a four-cylinder engine, the period of the output signal corresponds to 180 degrees of crankshaft rotation of the engine. This output signal is provided to a wave form shaper 7, which generates a square wave. In this example, as shown in FIG. 2*b*, the square wave has a rising edge when the output of the signal generator 6 exceeds a reference voltage Vr, and it has a falling edge when the output of the signal generator 6 falls below the reference voltage Vr. The output signal of the wave form shaper 7 is input to a duty cycle controller 12, which generates a square wave having a duty cycle which is determined by the voltage across a smoothing capacitor 8. The output signal of the duty cycle controller 12 is shown in FIG. 2*c*. It has a falling edge which coincides with a falling edge of the output of the wave form shaper 7. The duty cycle is given by $T_1/T$, wherein $T_1$ is the pulse width of the output signal of the duty cycle controller 12 and T is its period. The output of the duty cycle controller 12 is input to a drive circuit 13, which controls the opening and closing of a first switching element, which in this embodiment is in the form of a Darlington pair 3 having first and second transistors 3*a* and 3*b*. The drive circuit 13 supplies base current to the first transistor 3*a* of the Darlington pair 3 upon the rising edge of the output signal of the duty cycle controller 12, and it cuts off the base current upon a falling edge. The Darlington pair 3 is connected in series with the primary winding of an ignition coil 1. The positive terminal of the ignition coil 1 is connected to a direct current power supply, such as a storage battery. The ignition coil 1 has a secondary winding which is connected to the spark plugs 2 of the engine, only one of which is shown, through an unillustrated distributor. The emitter of the second transistor 3*b* of the Darlington pair 3 is connected in series with one end of a current sensing resistor 4, the other end of which is grounded.

The output voltage of the signal generator 6 is applied to the positive terminal of the smoothing capacitor 8 through a resistor 9 and a diode 10. The negative terminal of capacitor 8 is connected to ground. A resistor 11 is connected between the positive terminal of capacitor 8 and ground. The voltage across the capacitor 8 is input to the duty cycle controller 12 as a control signal.

The voltage across the capacitor 8 increases as the engine rotational speed increases, and the duty cycle of the duty cycle controller 12 increases as the voltage across the capacitor 8 increases. Therefore, the duty cycle increases with increasing engine rotational speed. Duty cycle control circuits which are responsive to a capacitor voltage are well known in the art, one being described in U.S. Pat. No. 3,836,672, for example. A duty cycle controller typically includes a time constant circuit having a capacitor and a transistor which is turned on and off by the smoothing capacitor 8 and which controls the charging and discharging of the capacitor of the time constant circuit.

The voltage across the current sensing resistor 4 is input to a first comparator 5, which generates a high output signal when the voltage across the current sensing resistor 4 exceeds a prescribed level corresponding to an upper limit on the primary winding current. The output signal of the first comparator 5, which is shown in FIG. 2*e*, is provided to the drive circuit 13 as a feedback signal. When the comparator 5 outputs a high level signal, the drive circuit 13 reduces the base current to transistor 3*a* of the Darlington pair 3 so as to limit the current flowing through the primary winding to the upper limit. As this time, a voltage drop appears across the Darlington pair 3, as shown in FIG. 2*f*. The primary winding current begins to rise from the rising edge of the output of the duty cycle controller 12, as shown in FIG. 2*d*. The primary winding current continues to rise until the first comparator 5 generates an output pulse, upon which the drive circuit 13 controls the Darlington pair 3 so as to maintain the primary winding current at a constant level.

The output of the first comparator 5 is also applied via a resistor 17 to the base of a transistor 14 and to the collector of another transistor 18. Transistor 14 serves as a second switching element for bypassing current around capacitor 8, and transistor 18 serves as a third switching element for preventing transistor 14 from bypassing current. The collector of transistor 14 is connected to the anode of diode 10 while its emitted is grounded. The emitter of transistor 18 is grounded, while its base is connected to the output terminal of a second comparator 16. The second comparator 16 compares the voltage across the smoothing capacitor 8 with a reference voltage, such as the battery voltage. It generates a high output signal when the reference voltage is higher than the voltage across the smoothing capacitor 8 and a low output signal at other times. When the first comparator 5 generates a high output signal and transistor 18 is off, transistor 14 turns on and bypasses current around the smoothing capacitor 8. However, when transistor 18 is turned on, transistor 14 is prevented from turning on regardless of the output of the first comparator 5, so transistor 14 is prevented from bypassing current around the capacitor 8.

Upon a falling edge of the output of the wave form shaper 7, the drive circuit 13 cuts off the base current to the first transistor 3*a* of the Darlington pair 3, so the Darlington pair 3 becomes an open circuit and the flow of current through the primary winding stops. This generates a high voltage in the secondary winding, and the spark plug 2 which is connected to the secondary winding at that moment generates a spark to ignite a cylinder of the engine.

When the engine is operating at idle speed or above, the voltage across the smoothing capacitor 8 is higher than the battery voltage. Therefore, the second comparator 16 generates a low output signal and keeps transistor 18 off, so transistor 14 can be gated by the first comparator 5 to bypass current around the capacitor 8. However, when the engine is cranking, the rotational speed of the engine is low, so the voltage across the smoothing capacitor 8 is lower than the battery voltage. Therefore, the second comparator 16 generates a high output signal which turns on transistor 18, and transistor 14 is prevented from bypassing current around the capacitor 8 when the first comparator 5 generates a high output signal. Therefore, an adequate primary winding current can be obtained during cranking, and ignition problems such as misfiring due to inadequate current are prevented.

In the illustrated embodiment, a Darlington pair 3 is employed as the first switching element and single transistors 14 and 18 are employed as the second and third switching elements. However, other conventional components can be employed as the switching elements. For example, the first switching element could be in the form of a single power transistor.

What is claimed is:

1. An ignition apparatus for an internal combustion engine comprising:

an ignition coil having a primary winding and a secondary winding;

a first switching member connected in series with the primary winding of the ignition coil;

current sensing means for determining when the current flowing through the primary winding reaches a prescribed level;

a signal generator which generates an alternating current signal is synchrony with the engine;

a capactor which is charged by the signal from the signal generator;

a duty cycle controller connected to the capacitor and the signal generator for generating an output signal which changes from a first level to a second level at a prescribed voltage of the signal generator output signal and which has a duty cycle which is a function of the capacitor voltage;

a drive circuit connected to the duty cycle controller for closing the first switching member while the duty cycle controller has the first level;

a bypass circuit responsive to the current sensing means for preventing the signal generator from charging the capacitor when the current sensing means determines that the primary winding current reaches the prescribed level; and bypass preventing means responsive to the capacitor for preventing the operation of the bypass circuit when the capacitor voltage is below a prescribed level.

2. An apparatus as claimed in claim 1, wherein:

the current sensing means comprises a resistor connected in series with the first switching member and a first comparator which compares the voltage across the current sensing resistor with a first reference voltage; and the bypass circuit comprises a second switching member which is connected to the signal generator in parallel with the capacitor and which is closed by the first comparator when the voltage across the resistor of the current sensing means exceeds the first reference voltage.

3. An apparatus as claimed in claim 2, wherein the second switching member comprises a transistor having a collector connected to the signal generator and the capacitor and a base connected to the first comparator.

4. An apparatus as claimed in claim 1, wherein the bypass preventing means comprises:

a second comparator which compares the voltage across the capacitor with a second reference voltage; and a third switching member connected between the first comparator and ground and gated by the output of the second comparator.

5. An ignition apparatus for an internal combustion engine comprising;

an ignition coil having a primary winding and a secondary winding;

a first switching element connected in series with the primary winding of the ignition coil;

a resistor connected in series with the first switching element;

a first comparator for sensing the voltage across the resistor and generating an output signal when the voltage exceeds a first reference voltage;

a signal generator for generating an alternating current signal is synchrony with the rotation of an engine;

a wave form shaper for generating an output signal which changes between a first level and a second level when the output of the signal generator has a prescribed voltage;

a capacitor which is charged by the output of the signal generator;

a duty cycle controller connected to the capacitor and the wave form shaper for generating an output signal which changes from a first level to a second level simultaneous with a change in the level of the wave form shaper and which has a duty cycle which is determined by the capacitor voltage;

a drive circuit responsive to the duty cycle controller for closing the first switching element while the duty cycle controller has the first level;

a bypass switching element connected to the signal generator in parallel with the capacitor and gated by the output of the first comparator;

a second comparator for comparing the voltage across the capacitor with a second reference voltage; and a bypass disabling switching element gated by the output of the second comparator and connected between the output of the first comparator and ground, the second switching element being closed by the second comparator to prevent the operation of the bypass switching element when the capacitor voltage is less than the second reference voltage.

* * * * *